United States Patent [19]

van den Broeke et al.

[11] Patent Number: 4,463,461

[45] Date of Patent: Aug. 7, 1984

[54] DISCHARGE PIT HAVING A WATER TRAP

[75] Inventors: Johan R. van den Broeke; Aleidus G. van den Broeke, both of Nijverdal, Netherlands

[73] Assignee: Viplex-Plastics B.V., Nijverdal, Netherlands

[21] Appl. No.: 455,586

[22] Filed: Jan. 4, 1983

[30] Foreign Application Priority Data

Jan. 19, 1982 [NL] Netherlands ..... 8200186

[51] Int. Cl.[3] ..... E03C 1/26

[52] U.S. Cl. ..... 4/288; 4/290; 4/291; 4/293

[58] Field of Search ..... 4/287, 288, 289, 291, 4/292, 290, 293; 137/247.33, 247.11, 247.35

[56] References Cited

U.S. PATENT DOCUMENTS

| | | | |
|---|---|---|---|
| 243,648 | 6/1881 | Stimpson | 4/289 X |
| 951,795 | 3/1910 | Barwanger | 4/289 X |
| 1,320,883 | 11/1919 | Martinez | 137/247.33 X |
| 4,045,346 | 8/1977 | Swaskey | 137/247.33 X |

FOREIGN PATENT DOCUMENTS

| | | | |
|---|---|---|---|
| 2032488 | 5/1980 | United Kingdom | 4/290 |

*Primary Examiner*—Henry K. Artis

*Attorney, Agent, or Firm*—Peter L. Klempay

[57] ABSTRACT

The invention has for its object to construct a discharge pit in a manner such that the height of incorporation is adjustable, whereas the effective height of the water trap remains unvaried under any condition so that the dimensions can always be adapted in the factory to the standards imposed by the authorities.

In order to achieve the above-mentioned object the invention provides a discharge pit with a water trap comprising a housing that can be fastened to the discharge tube, an annular pot vertically displaceable therein and having a perforated lid adapted to be mounted in the plane of the floor and having a tube stub extending vertically in the pot and having a predetermined height to form the water trap, said pot being vertically slidable in sealing relationship in said housing or around a tube end connected with the discharge tube.

3 Claims, 4 Drawing Figures

DISCHARGE PIT HAVING A WATER TRAP

Figure 1:
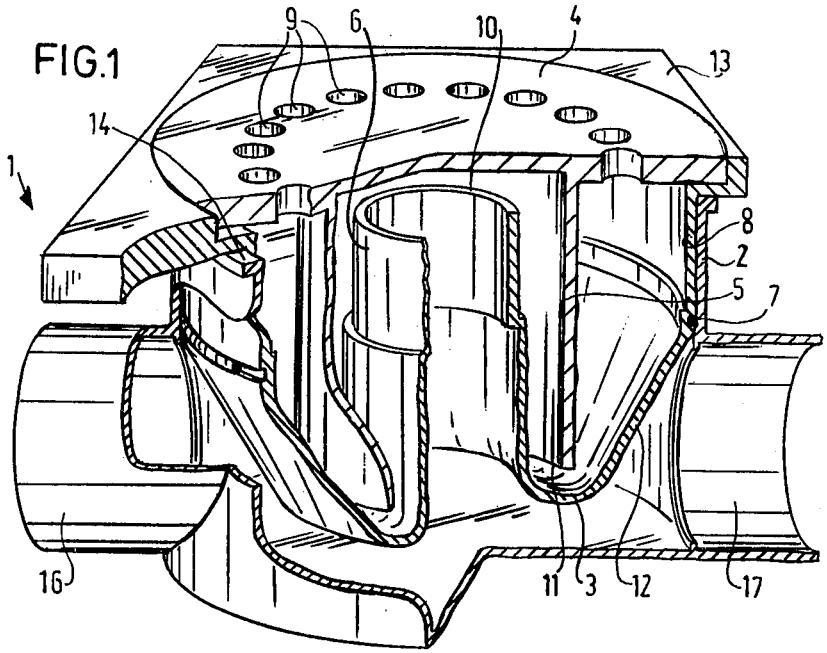

The invention relates to a discharge pit having a water trap. A discharge pit of known kind is intended to be built in, for example, the floor of a shower bath, a bathroom, a kitchen, scullery or the like. There are known pits of the so-called continuous flow type, that is to say, pits connected with a horizontal discharge pipe in the floor. There are furthermore known pits that can be connected with one end of a discharge pipe.

It is necessary for the height of the pit to be adjustable for matching to the optimum the distance between the discharge pipe concerned and the floor level.

The known pits are constructed so that they are, indeed, adaptable to the height, but this adaptability is attended by a smaller effective height of the water trap.

With regard to earlier problems involved in known discharge pits various national authorities have prescribed standards for the effective height of the water trap. In these cases a minimum, effective height of the order of magnitude of 50 to 60 cms is concerned.

With a view thereto the invention has for its object to construct a discharge pit in a manner such that the height of incorporation is adjustable, whereas the effective height of the water trap remains unvaried under any condition so that the dimensions can always be adapted in the factory to the standards imposed by the authorities.

In order to achieve the above-mentioned object the invention provides a discharge pit with a water trap comprising a housing that can be fastened to the discharge tube, an annular pot vertically displaceable therein and having a perforated lid adapted to be mounted in the plane of the floor and having a tube stub extending vertically in the pot and having a predetermined height to form the water trap, said pot being vertically slidable in sealing relationship in said housing or around a tube end connected with the discharge tube.

The invention will now be described more fully with reference to some arbitrarily chosen embodiments. The drawing shows in FIG. 1 a partially fragmentary, perspective view of a first embodiment of a discharge pit in its lowermost mounting position, FIG. 2 a cross-sectional view of the pit of FIG. 1 in its topmost mounted position, FIG. 3 a variant of the pit shown in FIGS. 1 and 2 in a partially fragmentary, perspective view and FIG. 4 a cross-sectional view of a third embodiment.

FIG. 1 shows a continuous flow pit 1 comprising a housing 2 adapted to be fastened to a discharge pipe, an annular pot 3 being vertically displaceable therein and having a perforated lid adapted to be mounted in the plane of a floor and having a tube stub 5 extending vertically in the pot, said pot 3 being vertically slidable with its central channel 6 in sealing relationship by means of a sealing ring 7 in said housing 2, that is to say, in contact with the cylindrical inner wall 8 thereof.

The lid 4 solely has perforations 9 in the portion extending beyond the tube stub 5. Through these perforations 9 the fluid to be evacuated enters the annular pot 3 and gradually fills the same until the top rim 10 of the central channel 6 is reached and an overflow of the fluid occurs for discharging it. Without further explanation it will be obvious that the effective height of the water trap is determined by the difference in height between the top rim 10 of the central channel 6 and the lower rim 11 of the tube stub 5. It is emphasized that when adjusting the height of the discharge pit 1 in this embodiment the pot 3 and the lid 4 are in common moved up and down so that the difference in height between the top rim 10 and the lower rim 11 remains constant.

The pot 3 has a substantially conical side wall 12, which adjoins on the underside the central channel 6 in a rounded-off manner and at its broad peripheral rim the pot has the sealing ring 7.

It should be noted that the sealing ring 7 should be made of a material resistant to the fluids to be discharged, that is to say, to chemical attack, to high temperatures or to temperature fluctuations, whilst the material must not be susceptible to ageing phenomena such as crumbling or hardening.

FIG. 1 shows the situation in which the discharge pit not yet mounted is disposed in its lowermost position, that is to say, the position in which the bottom face of a square flange 13 bears on the upper rim 14 of the housing 2.

Figure 2:
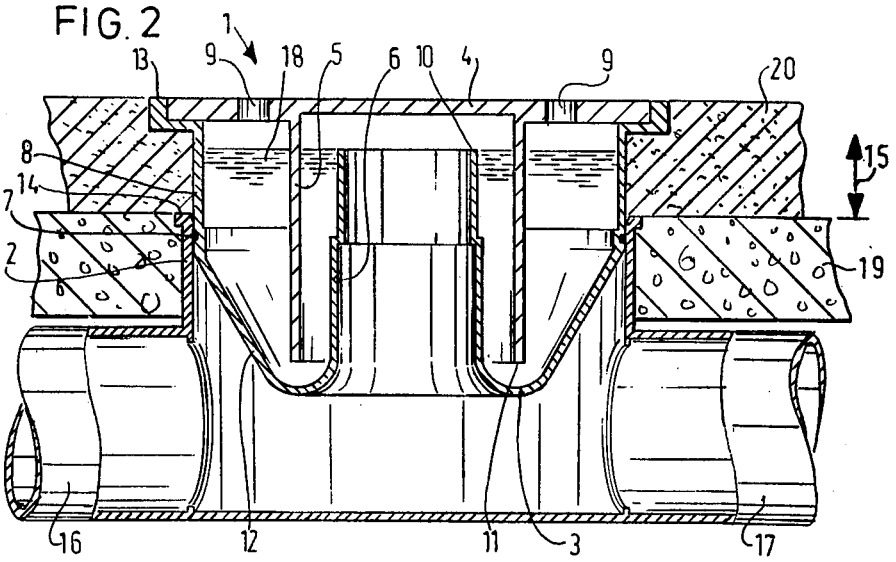

FIG. 2 shows the pit of FIG. 1 in the mounted state, in fact, in its substantially highest mounting position. A comparison with FIG. 1 directly shows that the sealing ring 7 is located very close to the top rim 14 of the housing 2.

The arrow 15 indicates the maximum adjustability of the discharge pit 1.

The conical shape of the side wall 12 and the rounded-off lower rim of the pot 3 ensure, even in the lowermost mounting position, a satisfactory flow between the tube stubs 16, 17 connected with the housing 2.

FIG. 2 shows furthermore a quantity of fluid 18, which has entered the pot through the perforations 9 and has reached the top rim 10 of the channel 6 so that a perfect stench trap is obtained between the central channel 6 and the perforations 9.

In the situation illustrated in FIG. 2 the housing 2 is fastened in a bottom layer 19, on which a floor 20 is poured. The top face of the lid 4 is located at the level of the top face of the floor 20.

Figure 3:
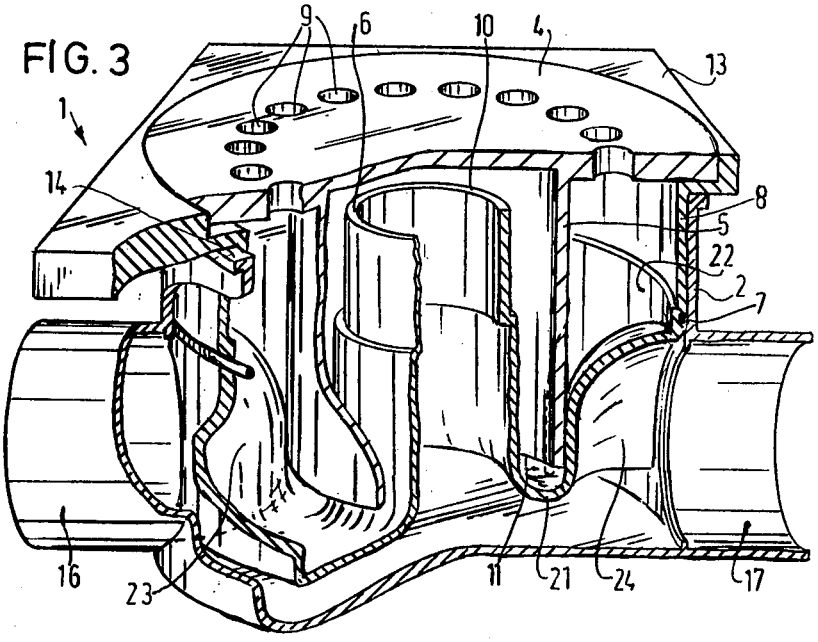

FIG. 3 shows a variant of the pit of FIGS. 1 and 2, which solely differs from the first embodiment in that the annular pot 21 has a substantially cylindrical outer jacket 22, which is provided in the areas of the tube stubs 16, 17 with inwardly depressed zones 23, 24 for enhancing a continuous flow.

Otherwise the embodiment shown in FIG. 3 is identical to that of FIGS. 1 and 2.

Figure 4:
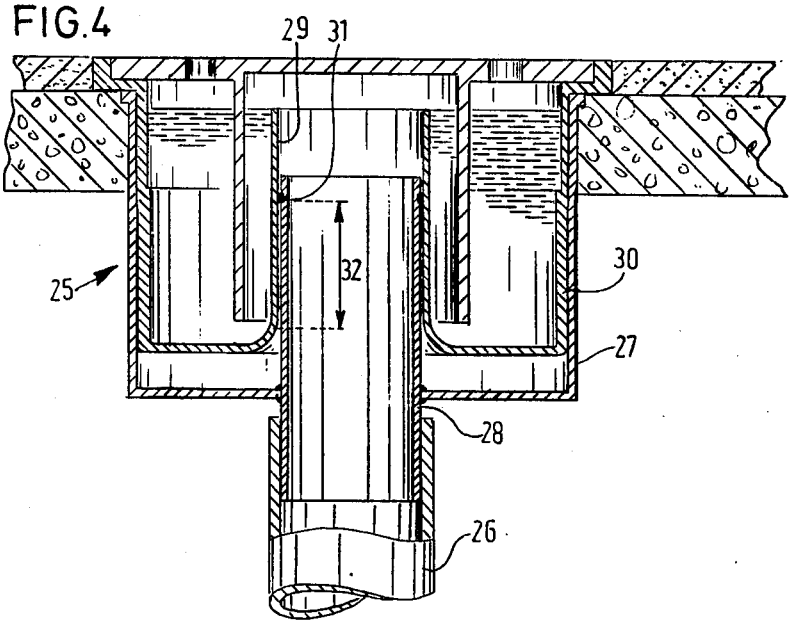

FIG. 4 shows an embodiment in which the pit 25 is adapted to be directly connected with a substantially vertical discharge pipe 26. To this end a housing 27 has a tube portion 28 connectable with the discharge pipe 26 and extending in the central channel 29 of a pot 30. The pot 30 can be vertically slid with close fit into the housing 27. This permits of adjusting the height.

The tube portion 28 is sealed against the pot 30 by means of a sealing ring 31 at the area of the central channel 29. An arrow 32 indicates the range in which the pit of FIG. 4 is adjustable.

After the foregoing description of the Figures it will be obvious how the pit shown in FIG. 4 will operate. A detailed description may, therefore, be dispensed with.

Obviously the invention is not limited to the embodiments shown and described.

We claim:

1. A discharge pit having a water trap and adapted to be connected to a discharge pipe, said discharge pit comprising:

a housing adapted to be connected to said discharge pipe;

an annular pot vertically displaceable within said housing and having an outer cylindrical wall, an inner cylindrical wall of lesser height than said outer wall, and a bottom wall connecting said outer and inner walls, one of said outer and inner walls slidably engaging said housing;

a perforated lid removably supported on the upper end of said outer wall and having a tube stub extending vertically within said annular pot; and a seal carried by said annular pot and engaging said housing.

2. The discharge pit of claim 1 wherein said housing includes an upwardly extending cylindrical wall adapted for sliding engagement with said outer wall of said pot, said seal being positioned between said outer wall and said upwardly extending wall.

3. The discharge pit of claim 1 wherein said housing includes an upwardly extending cylindrical wall adapted for sliding engagement with said inner wall of said pot, said seal being positioned between said inner wall and said upwardly extending wall.

* * * * *